US006035563A

United States Patent [19]

Hoefer et al.

[11] Patent Number: 6,035,563

[45] Date of Patent: Mar. 14, 2000

[54] ELECTRIC IRON WITH A SOLEPLATE AND PIEZOELECTRIC SPRAYER

[75] Inventors: Klaus Hoefer; Andreas Walther, both of Hanau, Germany

[73] Assignee: Rowenta-Werke GmbH, Offenbach, Germany

[21] Appl. No.: 09/242,794

[22] PCT Filed: Aug. 20, 1997

[86] PCT No.: PCT/EP97/04518

§ 371 Date: Feb. 23, 1999

§ 102(e) Date: Feb. 23, 1999

[87] PCT Pub. No.: WO98/07919

PCT Pub. Date: Feb. 26, 1998

[30] Foreign Application Priority Data

Aug. 24, 1996 [DE] Germany ..... 196 34 276

[51] Int. Cl.[7] ..... D06F 75/22

[52] U.S. Cl. ..... 38/77.1; 38/93

[58] Field of Search ..... 38/37.1, 37.3, 38/77.5, 77.8, 77.83, 93; 318/116; 417/413.2, 322; 310/12, 330

[56] References Cited

U.S. PATENT DOCUMENTS

| | | | |
|---|---|---|---|
| 1,859,167 | 5/1932 | Prenzel | 38/93 |
| 2,802,288 | 8/1957 | Hoecker | 38/77.5 |
| 3,238,650 | 3/1966 | Mullen | 38/93 |
| 3,534,488 | 10/1970 | Hardwick et al. | 38/77.3 |
| 4,545,561 | 10/1985 | Brown | 310/330 X |
| 5,787,614 | 8/1998 | Stutzer | 38/77.1 |
| 5,979,089 | 11/1999 | Bouleau et al. | 38/93 X |

FOREIGN PATENT DOCUMENTS

| | | |
|---|---|---|
| 0358310 | 3/1990 | European Pat. Off. . |
| 1087107 | 8/1960 | Germany . |
| 214404 | 10/1984 | Germany . |
| 4310273 | 10/1994 | Germany . |

*Primary Examiner*—Ismael Izaguirre
*Attorney, Agent, or Firm*—Milde, Hoffberg & Macklin, LLP

[57] ABSTRACT

An electric iron has a soleplate with a front tip and at least one passage for a liquid stored in a liquid tank system for wetting an article to be ironed. The passage is arranged in the area of the front tip symmetrically to a central line which starting from the front tip divides the soleplate in the middle. The liquid exits the passage in the form of liquid droplets generated by a piezoelectrically driven sprayer arranged above the soleplate. The electric iron is characterized in that the sprayer (12, 13, 14, 29) has at least one piezoelectrically driven thin membrane plate (12) with a plurality of spraying holes (24) associated with the respective passage (11) of the soleplate (6) and having a mean clear width from 30 to 100 μm. The number of spraying holes (24) is selected to ensure that the amount of liquid dispensed through the soleplate (6) does not exceed about 8 g/minute. The passages (11) are maximum 10 mm wide, whatever their length.

20 Claims, 5 Drawing Sheets

ELECTRIC IRON WITH A SOLEPLATE AND PIEZOELECTRIC SPRAYER

BACKGROUND OF THE INVENTION

The present invention relates to an electric iron with a soleplate that contains a soleplate tip, and that has at least one opening symmetrical to a center line that divides the soleplate in the center beginning at the soleplate tip. This opening is located in the soleplate and in the area of the soleplate tip and allows a liquid that is stored in a liquid tank system to pass through and moisten materials to be ironed. The liquid exits the opening in the form of liquid droplets that are generated using a piezoelectric excitation atomizer device above the soleplate.

An electric iron of the type mentioned above is known from the German Patent No. DE-A1 43 10 273.

In household applications, the best ironing results, that is, optimum smoothness with minimum time spent, are achieved with steam irons or steam iron stations. The steam performance of the steam irons is around 10–30 g/minute and that of the steam stations up to 60 g/minute. The generated steam serves two purposes: as a convective heat transfer medium and to moisten the material to be ironed. Both functions are essential for smoothing natural fibers such as cotton, linen and wool. However, to achieve optimum ironing results, a so-called ironing humidity of about 15 percent in weight is required.

Such results are only achieved using very time-consuming classical sprinkling of the laundry with water by hand prior to ironing. Here, the disadvantages are uneven distribution and difficult metering.

With conventional steam ironing devices, the ironing humidity required for optimum ironing results is not achieved, even at a high steam performance, because condensation no longer takes place at temperatures of 100° C. in the fabric, a temperature that is exceeded significantly when passing over the fabric with the iron. In addition, a major portion of the steam passes through the material to be ironed without being utilized and leads, in general, to an unpleasant work environment.

An additional disadvantage of steam irons is that the user needs to apply so-called ironing aids such as starch, gliding improvers, scents, finishing agents, etc., to the material to be ironed in a separate operation.

Direct inclusion of these ironing aids in the water tank for the steam production is not feasible because vaporizing will make these aids ineffective. In addition, the resultant deposits in the evaporation chamber would destroy the ironing devices over time.

To avoid all these disadvantages, in the iron disclosed in the German Patent No. DE-A1 43 10 273, liquid droplets are generated using a piezoelectric converter. The generation of the liquid droplets occurs in a large-dimensioned evaporation chamber that is open on the side of the ironing surface, where the chamber is surrounded, frame-like, by the heated soleplate. The disadvantage with this known iron is, however, that the heated part of the soleplate does not have a sufficient surface area, due to the very large evaporation chamber, to sufficiently smooth the difficult-to-smooth natural fabrics and to dry the moistened fabric to be ready for hanging in the closet. An additional disadvantage is, that objects attached to the material to be ironed, such as buttons, can get caught in the evaporation chamber and tear off.

Another iron is known from the East German Patent No. DD-PS 214 404. With this iron, the atomization occurs in a separate aerosol chamber where an electromechanical ultrasound atomizer system is located. Using an externally controllable advancement device, the aerosol is then advanced to an additional distribution chamber and from there to individual aerosol distribution channels that end in aerosol exit openings located in the soleplate. With such a design, there is the danger that the aerosol condenses on the walls of the flow channels or that the individual aerosol droplets form larger drops along the flow path from the interior aerosol chamber to the exit openings, such that large liquid drops exit from the exit openings in the soleplate. This causes spots saturated with liquid on the material to be ironed that do not dry during the normal ironing procedure.

A steam iron with a pot evaporator designed in the shape of a disk is known from the German Patent Publication No. DE-AS 10 87 107. In this iron, the steam flows such that the water supply cannot get to the openings in the soleplate where the steam exits, even at various positions of the iron. The openings in the soleplate where the steam exits during ironing are arranged in a circle with circular cross-sections or cross-sections in the shape of elongated holes.

The European Patent No. EP-A1 0 358 310 deals with a steam iron where the openings in the soleplate are distributed such that they are either located on a centerline that divides the soleplate in the center beginning at the soleplate tip, or are located parallel to this line. These openings are provided in the shape of elongated holes or slots; in one embodiment, a single opening is provided approximately at the center of the soleplate.

SUMMARY OF THE INVENTION

Based on the state-of-the-art described above, it is the object of the present invention to create an electric iron where the above-mentioned disadvantages are avoided and, in particular, where a defined moisture application to the material to be ironed is ensured without the possibility of creating spots saturated with liquid, and comparably good ironing results are achieved on the material to be ironed in all directions of movement of the iron's soleplate.

Based on the above-mentioned state-of-the-art in this subject matter, this object, mentioned above, is achieved by the improvement wherein the atomizing device contains at least one thin membrane plate that is excited piezoelectrically, wherein the membrane plate has a multitude of atomizer openings that are assigned to the respective opening of the soleplate, wherein these openings have an opening breadth of 30 to 100 $\mu$m, wherein the number of atomizer openings is selected such that a liquid delivery via the soleplate of up to a maximum of 8 g/minute is ensured, and wherein the openings have a maximum width of 10 mm regardless of their length.

Because of the design according to the invention, the atomization of the liquid occurs directly in the area of the soleplate; that is, in the atomizer openings that are located directly at the openings above the soleplate. The atomizer openings with their mean opening breadths of 30 to 100 $\mu$m are dimensioned such that no liquid can exit from the openings when the atomizing device is not actuated. In addition, the number of atomizer openings is designed such that a liquid delivery of up to a maximum of 8 g/minute is ensured. Depending on the mean opening breadth in the range of 30 to 100 $\mu$m, this requires about 70 to 100 atomizer openings, which in turn leads to fine atomization. The symmetrical arrangement of the individual openings in relation to the center line, which divides the soleplate beginning at the tip of the soleplate, ensures that the material to be ironed is moistened uniformly and then smoothed and dried in all directions of the movement of the iron across the material to be ironed. The openings can be designed relatively long; however, it must be ensured that they have a maximum width of 10 mm so that no object present on the material to be ironed, such as buttons, can be caught in these openings thereby damaging the material to be ironed during ironing. In addition, the openings are rounded at the area of transition to the surface of the soleplate. Because the individual atomizer openings are at a certain distance to the soleplate surface, the liquid that is atomized at the atomizer openings can initially expand without restriction in the openings of the soleplate before the liquid particles touch the material to be ironed.

Using this manner of moistening, up to 50% better ironing results than with conventional steam irons can be achieved with usual fabrics such as linen, cotton, silk and synthetic fibers and blends, or, considering the same ironing smoothness, up to 50% ironing time can be saved. In particular, the iron design according to the invention distinguishes itself by the uniform distribution of the liquid in very fine droplets that reach the material to be ironed by passing through the openings.

An additional advantage consists of the fact that the user can add to the liquid tank any kind of suitable additives, such as finishing agents, starch, shine agents, scents, gliding improvers, sizing, disinfectants, etc. that will be brought to the material finely distributed together with the droplet mist from the atomizer openings without the additives being separated from the liquid, generally distilled water, or without a premature evaporation of certain particles, which is the case when such additives are used in conventional steam irons.

Advantageous is the active heating of the entire ironing surface, which is surrounded by the openings, by suitable heating elements and the thermally conductive connection of this surface via a link with the likewise heated surface of the soleplate outside the part that is surrounded by the openings such that the entire ironing surface exhibits a uniform heat distribution. For this reason, in a preferred embodiment, the individual openings in the soleplate, and thus the atomizer openings assigned to these openings, are arranged in a circular manner such that the area of the soleplate, which is surrounded by the circle of the openings, forms a sufficient area to assign a heating element to this area. If the individual openings have a distance from one another such that, under preferable use of elongated holes, links remain between the openings, heating elements can be directed along the links on the inside of the soleplate.

It has been shown that the openings should have a preferable design as elongated holes or circular sections with a preferred maximum number of holes in the soleplate of 6, preferably 3 or 4. This ensures that the material to be ironed is moistened uniformly when the iron is moved in any direction, because, those areas on the material to be ironed that are covered by the links when the iron is moved and are not moistened will definitely be gone over by the next opening and, thus, moistened.

If three openings are provided, they should each occupy a radial circular section of up to 100° in relation to the center of the circle where the openings are located. This results in free space between neighboring openings, each occupying a circular section of 20° in relation to the center.

To additionally ensure that no liquid droplets will escape from the atomizer openings when no moistening is desired during ironing, a low pressure should be maintained during ironing in the area above the membrane plate, which is covered with liquid. Such a low pressure can be established, for example, via the ventilation of the tank from which liquid is taken during ironing.

While the atomizer openings have a mean opening breadth of 30 to 100 $\mu$m, an opening breadth of 45 to 60 $\mu$m is preferred. This range ensures that, on one hand, sufficient liquid quantities are delivered via the openings and, on the other hand, the size of the liquid droplets is sufficiently small, and that liquid is prevented from exiting the atomizer openings without actuating the atomizer device.

To achieve uniform moistening, on the one hand, and quick drying and smoothing of the material to be ironed, on the other hand, the openings should be arranged in a circle with a diameter of 50 to 100 mm, preferably about 70 mm. With the usual dimensions of the soleplate, this leaves a sufficient area on all sides around these openings to the edge of the soleplate that is heated and that glides across the material to be ironed.

For quick and immediate delivery of liquid to the material to be ironed, the internal structure of the atomizer device is selected such that in the basic position of the iron, that is, while ironing—the membrane plate (or the membrane plates) borders (or border) the liquid supply as wall section. This means that the liquid sits directly above the membrane plate and thus, above the atomizer opening or even in the atomizer opening itself, and the liquid can then exit the atomizer openings under oscillation of the membrane plate without a time delay.

To ensure that while ironing and when the iron is moved back and forth quickly, or is slanted differently, there is always a sufficient liquid level above the membrane plate that can be atomized immediately from the openings when the atomizer device is actuated, the liquid supply to the membrane plate and the liquid removal from the membrane plate is baffled. This can be achieved, for example, by providing adequate flow restrictors in the form of narrowed channels or the like.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
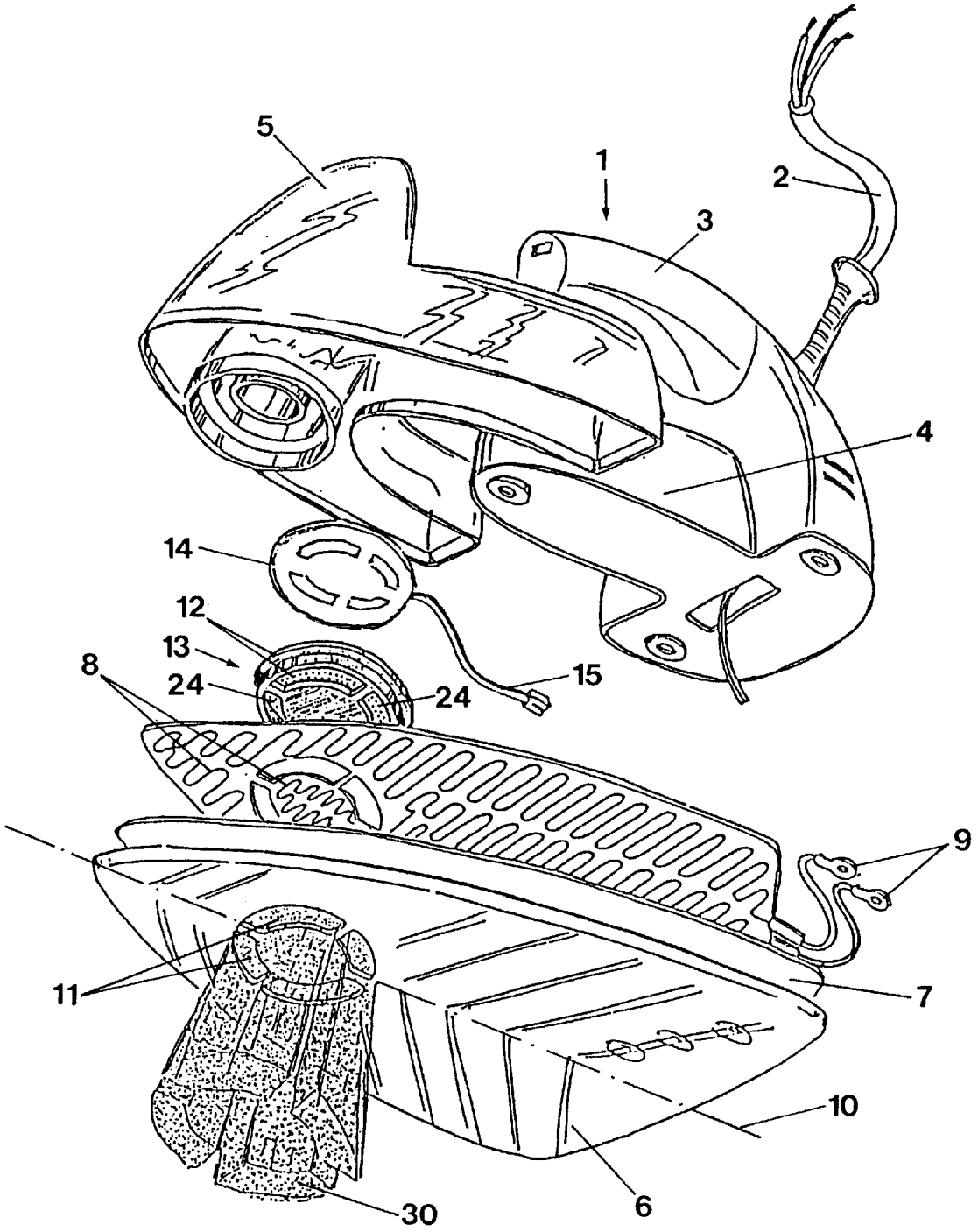
FIG. 1 is an exploded view of the iron subject to the invention with a schematically illustrated liquid exit from the soleplate.

The present invention will now be described with reference to FIGS. 1–5 of the drawings. Identical elements in the various figures are identified by the same reference numerals.

The iron, as shown in the exploded view of FIG. 1, features a main housing 1 with a power connection 2 for the electrical supply and integrates a handle 3 on its upper side. The main housing 1 contains a mid-section housing extension 4, which is surrounded by a U-shaped front housing section 5 that serves as water storage container, among other things. This front housing section 5 is attached to the main housing 1 with elements not shown in detail.

A soleplate 6 is bolted against the bottom side of the main housing 1 and the front housing section 5, where a heating element carrier plate 7 is placed on the inside of this soleplate, and this carrier plate carries electrical heating elements 8. Two connection lugs 9 are provided for the electrical supply of the electrical heating elements 8.

In the area of the front third of the soleplate 6, four openings 11 that penetrate the entire soleplate 6 are provided symmetrically to a centerline indicated by a dot-dash line 10 in FIG. 1. A membrane plate 12 that is held by a round carrier component 13 is assigned to these four openings 11. This membrane plate 12 is held at its edge in the carrier component 13 such that it can oscillate freely at least in the area of the openings 11 that are also provided in the carrier component 13. Arranged on the membrane plate 12 is a piezoelectric element 14 that is structured in the shape of a circular ring. The piezoelectric element 14 can be connected via an electrical lead 15 with an excitation component (not shown), which is located in the main housing 1.

Figure 2:
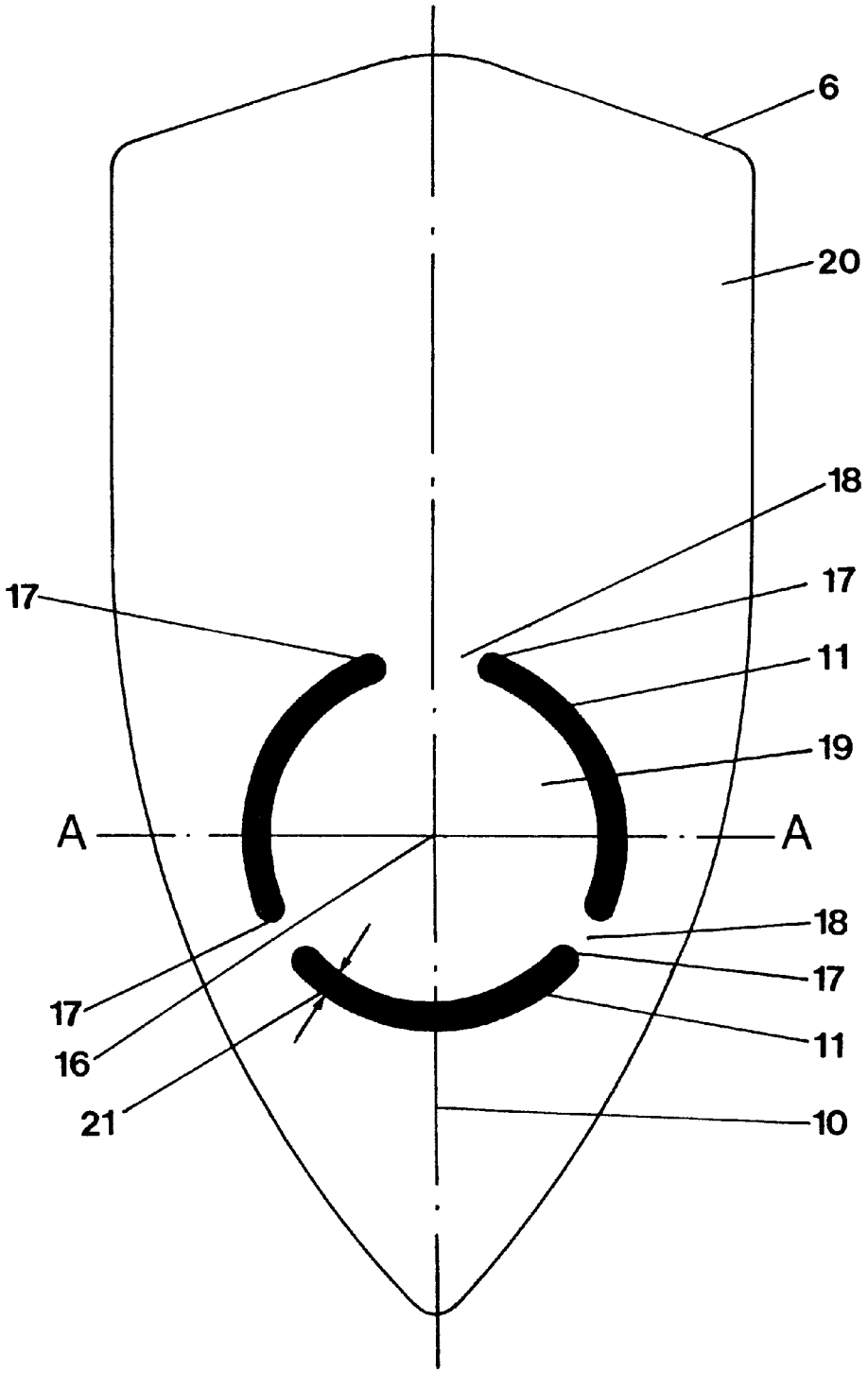
FIG. 2 is a top view of a soleplate with openings, where, however, different from the design in FIG. 1, three openings are provided.
Figure 3:
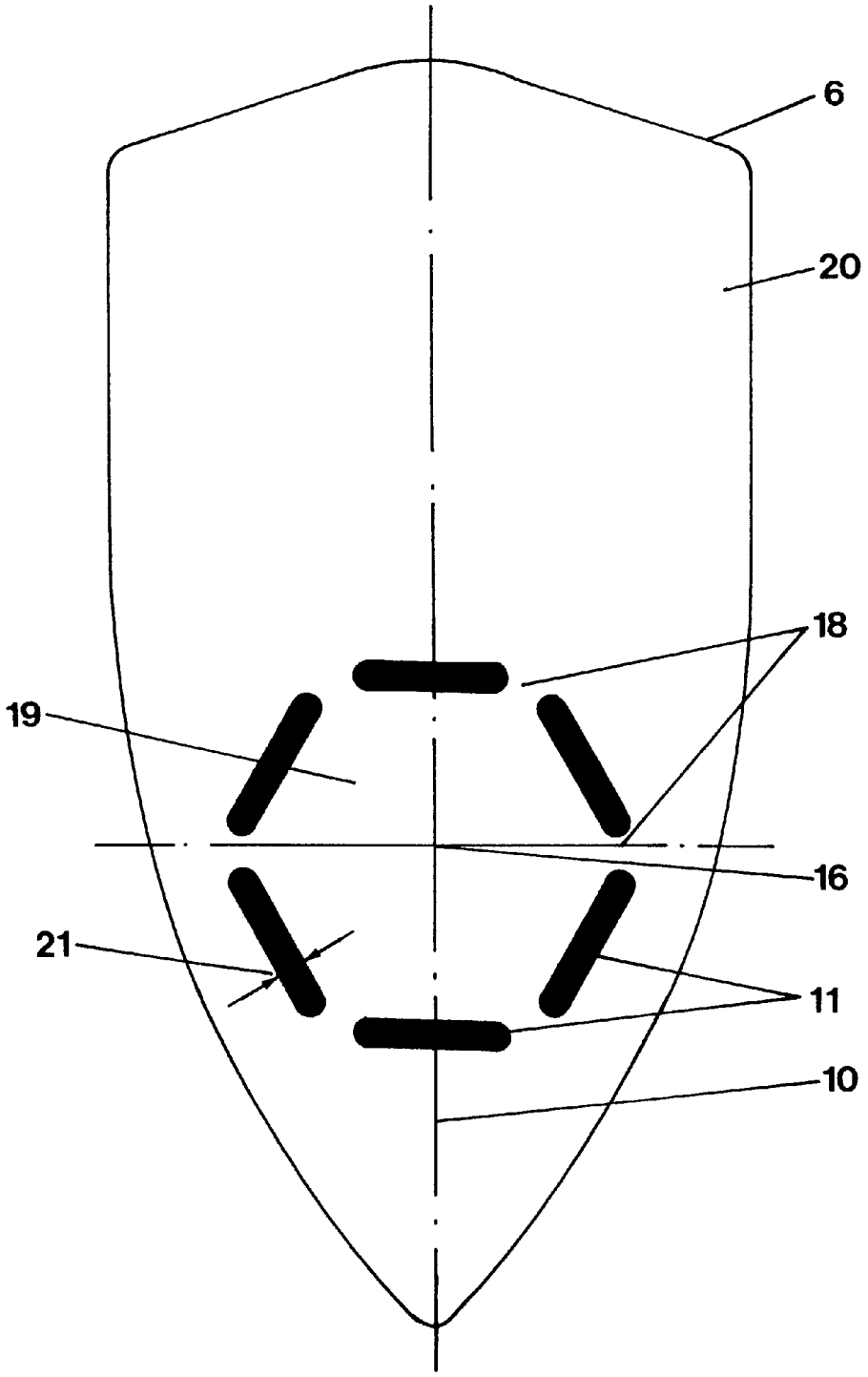
FIG. 3 is a top view of a soleplate comparable with FIG. 2, however, with six openings in the shape of elongated holes.
Figure 4:
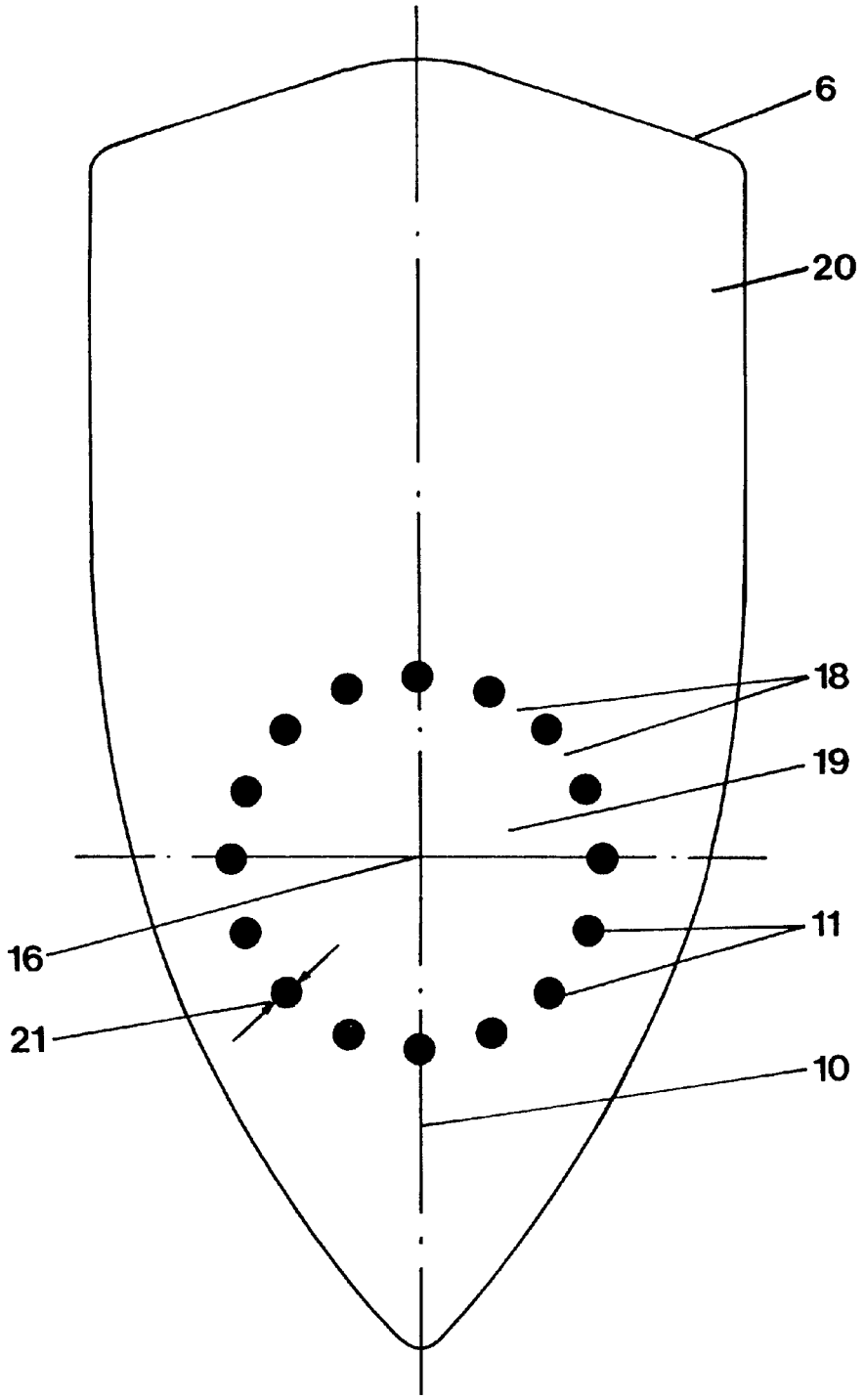
FIG. 4 is another top view of a soleplate with circular openings arranged in a circle.

FIGS. 2, 3 and 4 show various arrangements of the openings 11 that are suitable in connection with the atomization of liquids performed with the piezoelectric element 14 in the soleplate 6. In general, the arrangement of the openings 11 is basically symmetrical to the centerline 10 as well as located on a circle whose center point has the reference designation 16 in FIGS. 2 to 4.

According to the design in FIG. 2, the number of openings 11 is three, where these individual openings are structured as curved elongated holes, where each occupies a circular segment of about 100° in relation to the center point 16. The ends 17 of each opening 11 are each at such a distance from one another, that a link 18 remains between them, which connects the sole area 19 that is surrounded by the openings 11 with the remaining sole area or sole surface 20 respectively.

A total of six openings 11, running symmetrical to the center line 10, are provided in a third design of the openings 11, that is presented in FIG. 3. However, contrary to the embodiments of FIGS. 1 and 2, these are straight elongated holes that touch equally distributed an imaginary circle with a center marked with the reference 16.

Finally, FIG. 4 shows an arrangement of openings 11 that is, however, not to be viewed as preferred in the shape of circular bores, that is, a total of 16 bores, that are arranged in a circle with the center 16. The diameter of the circle, that each of the openings 11 is centrally aligned at, or that touch the circle with their center lines, is about 60 to 65 mm. The width of the openings, each designated with the reference mark 21, that is, the dimension perpendicular to the longitudinal expansion of the individual elongated holes, is approx. 5 mm; this small width ensures that no parts of the material to be ironed, such as buttons, can be caught in these openings during ironing.

On the other hand, this dimension is sufficient to achieve an essential delivery of liquid.

Figure 5:
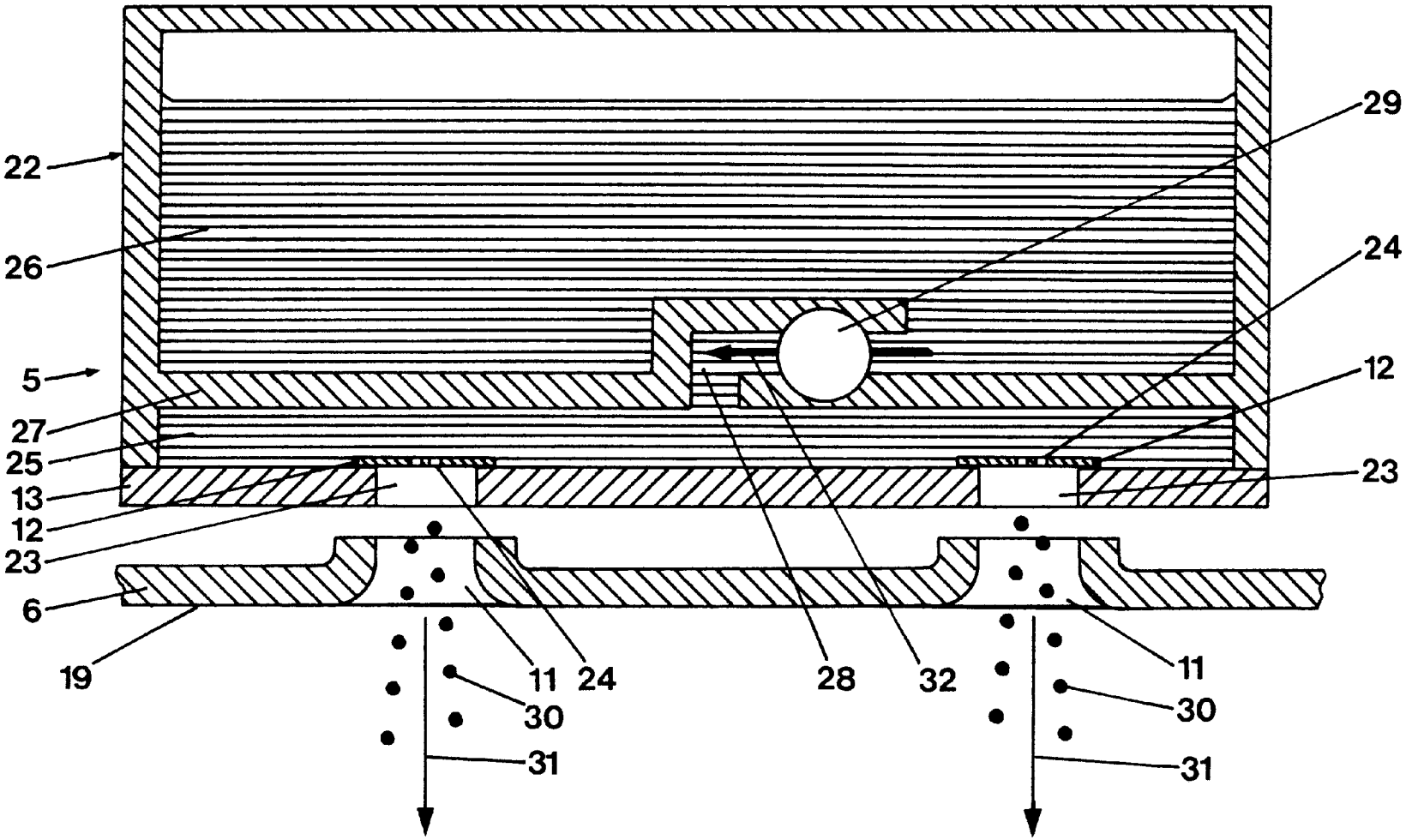
FIG. 5 is a cross-section along the cross-sectional line A—A of FIG. 2.

In an embodiment as presented in FIG. 5, a tank system 22, which may be comprised of the front housing section 5, is located above the soleplate 6. This tank system 22 contains a carrier plate that is comparable to the carrier component 13 in FIG. 1, which in turn contains openings 23, that are comparable to the openings 11 in the soleplate 6 with regard to their dimensions. A membrane plate 12, such as is also shown in FIG. 1, is located on the upper side of this carrier component 13 and in turn contains a multitude of atomizer openings 24. This membrane plate 12 has a relatively thin design such that it can oscillate easily in the area of the openings 23 when held in place at the edge of the carrier component 13. A chamber 25 that contains a portion of the liquid that is to moisten the material to be ironed is present directly above this membrane plate 12. Another liquid reservoir 26, which constitutes the main liquid reservoir of the iron, is provided above the chamber 25 and is separated from the chamber 25 by a separating wall 27.

The chamber 25 and the main reservoir 26 are connected to one another via a connecting channel 28. To ensure suitable pressure conditions in the chamber 25, a pump 29 or another suitable device can be provided in the connecting channel 28. This pump or device will advance liquid from the main reservoir 26 to the chamber 25, indicated by an arrow 32, in all operating modes of the iron such that the chamber 25 is, preferably, entirely filled with liquid. On the other hand, suitable pressure conditions for the delivery of liquid droplets 30 are achieved where these droplets are delivered perpendicular to the surface of the soleplate as indicated by the directional arrow 31, as can be seen in FIG. 1.

As can be recognized in FIG. 5, the liquid droplets 30 are generated directly in the area of the soleplate 6, that is, in the openings 11 of the soleplate, or in the openings 23 in the carrier component 13, respectively.

In the embodiment shown in FIG. 1, the membrane plate 12, as can be seen in FIG. 5, is set into vibration by a piezoelectric element 14, which is suitably located above the membrane plate 12, to achieve a delivery of liquid droplets 30 in a defined amount. The diameter of the individual atomizer openings 24 should be in a range of 30 to 100 $\mu$m, with preferred opening breadths of 45 to 60 $\mu$m, to achieve a fine atomizer spray mist. With such dimensions and with a radius of the circle where the openings 11 are located, of about 60 to 70 mm, the number of these atomizer openings is selected such that a maximum of 8 g/minute of liquid is delivered from the liquid container 25 to the material to be ironed.

The symmetric arrangement of the openings in relation to the center line 10, or the arrangement in a circle with the center point 16 ensures that a defined zone on the material to be ironed is moistened when moving the soleplate across the material to be ironed. Even with several changes in direction, uniform moistening is ensured each time, because a practically ring-shaped volume of liquid droplets is delivered, as indicated in perspective in FIG. 1. In addition, no cold areas are formed on the soleplate, because the heating element 8 is arranged such that even the sole area 19, which is surrounded by the openings 11, is heated, as can be recognized especially when viewing FIG. 1.

There has thus been shown and described a novel electric iron with a soleplate which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

We claim:

1. In an electric iron with a soleplate that includes a soleplate tip and at least one opening arranged symmetrically to a centerline that separates the soleplate in the center beginning at the soleplate tip used for the passage of liquid stored in a liquid tank system for the moistening of material to be ironed, where the liquid exits from the soleplate in the form of liquid droplets that are generated using a piezoelectric exciter atomizer device located above the soleplate, the improvement wherein the atomizer device contains at least one piezoelectrically excited thin membrane plate that has a multitude of atomizer openings assigned to the respective opening of the soleplate; wherein said openings have a mean opening width of 30 to 100 $\mu$m; wherein the number of atomizer openings is selected such that a liquid delivery via the soleplate of up to a maximum of about 8 g/minute is ensured; and wherein the openings have a maximum width of 10 mm regardless of their length.

2. The electric iron according to claim 1, wherein the openings are arranged and distributed around a center point on the centerline of the soleplate.

3. The electric iron according to claim 1, wherein neighboring openings are distanced from one another by links.

4. The electric iron according to claim 3, wherein the openings are arranged in a circular manner.

5. The electric iron according to claim 4, wherein the openings are arranged on a circle with a diameter in the range from 50 to 100 mm.

6. The electric iron according to claim 5, wherein the openings are arranged in a circle with a diameter of approximately 70 mm.

7. The electric iron according to claim 4, wherein the openings are designed as elongated holes.

8. The electric iron according to claim 7, wherein the number of openings in the soleplate is a maximum of six.

9. The electric iron according to claim 8, wherein three openings are provided that each occupy a radial section of up to 100° in relation to the center point.

10. The electric iron according to claim 8, wherein a heating element is assigned to the area of the soleplate that is surrounded by the openings.

11. The electric iron according to claim 8, wherein the number of openings is three.

12. The electric iron according to claim 8, wherein the number of openings is four.

13. The electric iron according to claim 1, wherein while ironing, low pressure is maintained in at least one area above the membrane plate which is covered with liquid.

14. The electric iron according to claim 1, wherein the opening width of the atomizer openings is in the range from 45 to 60 $\mu$m.

15. The electric iron according to claim 1, the openings have a maximum width of 6 mm.

16. The electric iron according to claim 1, wherein while ironing, the membrane plate borders the liquid supply as wall components.

17. The electric iron according to claim 1, wherein the number of atomizer openings is in the range of 70 to 100.

18. The electric iron according to claim 1, wherein the liquid supply and the liquid removal from the membrane plate are baffled.

19. The electric iron according to claim 1, wherein the openings are rounded in the transitional area to the soleplate surface.

20. The electric iron according to claim 4, wherein the openings are designed as circular sections.

* * * * *